United States Patent [19]

Nienstedt

[11] 3,979,986

[45] Sept. 14, 1976

[54] DEVICE FOR DIVIDING RECTANGULAR BARS SINGLY AND IN MULTIPLES PRODUCED IN PARTICULAR BY DIVIDING RECTANGULAR BLOCKS ESPECIALLY OF DEEP FROZEN FISH

[76] Inventor: Heinz Nienstedt, Zum Nonnenberg 8a, 435 Recklinghausen, Germany

[22] Filed: Sept. 16, 1975

[21] Appl. No.: 613,910

[30] Foreign Application Priority Data

Sept. 16, 1974 Germany ..... 2444139

[52] U.S. Cl. ..... 83/420; 83/407; 83/446; 83/449

[51] Int. Cl.[2] ..... B26D 7/16

[58] Field of Search ..... 83/420, 407, 446, 449, 83/444

[56] References Cited

UNITED STATES PATENTS

| | | | |
|---|---|---|---|
| 3,474,694 | 10/1969 | Neustadter et al. | 83/449 |
| 3,780,609 | 12/1973 | Storti | 83/420 |
| 3,880,035 | 4/1975 | Divan | 83/420 |

*Primary Examiner*—J. M. Meister
*Attorney, Agent, or Firm*—Haseltine, Lake & Waters

[57] ABSTRACT

A device for dividing rectangular bars singly and in multiples produced by dividing rectangular blocks especially of deep-frozen fish which includes a table with a laterally adjustable stop for the bars to be cut and at least one dividing element arranged at a lateral distance therefrom and in particular an endless saw blade, wherein a further lateral stop is positioned on the opposite side of the first lateral stop under formation of a transit slot for the bars; these two stops are coupled by a gear so that they can be uniformally pressed apart against the force of a spring.

5 Claims, 1 Drawing Figure

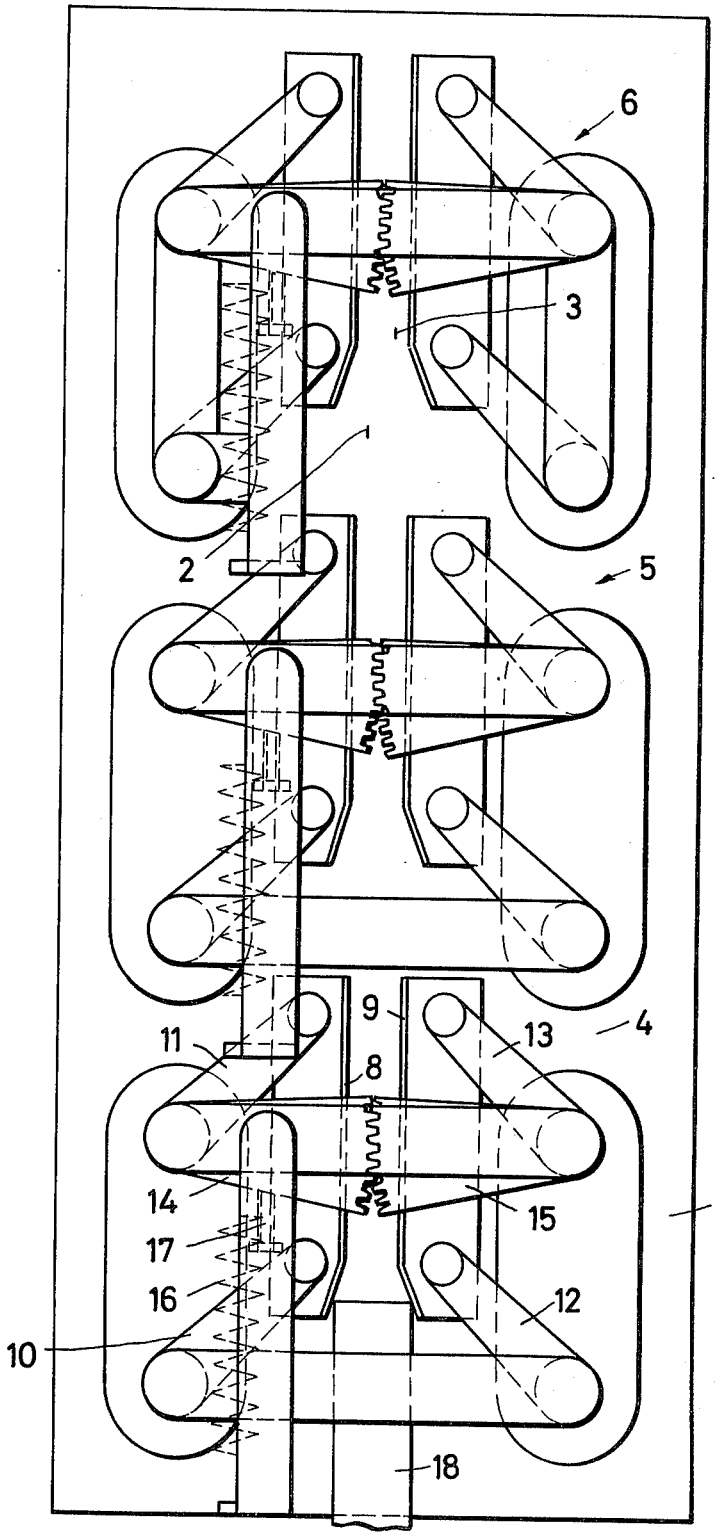
6
3
2
5
9
4
11
13
8
14
15
1
17
16
12
10
18

DEVICE FOR DIVIDING RECTANGULAR BARS SINGLY AND IN MULTIPLES PRODUCED IN PARTICULAR BY DIVIDING RECTANGULAR BLOCKS ESPECIALLY OF DEEP FROZEN FISH

The invention relates to a device for dividing rectangular bars singly and in multiples produced in particular by dividing rectangular blocks, comprising a table with a laterally adjustable stop for the bars to be cut and at least one dividing element arranged at a least one dividing element arranged at a lateral distance therefrom, in particular an endless saw blade.

Such a device can be preferably used in apparatus for sawing flat rectangular blocks into rectangular sticks consisting of several intersecting saws, which divide the blocks into increasingly smaller rectangular units by vertical to inclined cuttings, and consisting of a transport equipment arranged between the individual saws; the said saws comprising a saw for blocks, which divides the blocks into small units with a saw table provided with transport equipment for the removal of the blocks during the sawing process, a saw for discs which immediately divides the smaller units coming from the saw for blocks into still smaller units, and a saw for sticks which divides the units coming from the saw for discs into sticks, as well as a turning and disc separating device positioned after the saw for blocks, from this separating device the discs can be fed transversely by means of transport equipment positioned before the saw, whereby the saw for blocks divides the blocks into bars in single cuttings following one after the other, these bars are then fed one after the other by the following transport equipment into the saw for discs; and has a reversing table in the saw for blocks divided into three parts for single cutting in the direction of transport, the front and back parts of said reversing table being movable for the repeated one-way passage of the blocks into the saw table in a position outside the line of transport of the middle part and in the line of transport of the saw table and back in the line of transport of the middle part, whereby the middle part of the saw table has a stop guide adjusted to the width of the bars to be sawn, and that the first set of transport equipment is connected to the front part of the reversing table which has moved into the line of transport of the saw table and that the turning and disc separating device is arranged between the saw for discs and the saw for sticks.

Such a device is the subject of the U.S. Pat. application Serial No. 437,956.

Fish sticks are known to be produced from larger rectangular blocks by sawing these blocks in vertical planes. In so doing, a certain weight for each sick is aimed at, in order to reach a certain total weight with a certain total weight with a certain number in one pack. The more exact the weight of each stick, the greater the efficiency because then extra weight is not given to the sticks to avoid underweight. It is in fact possible to direct the cuttings exactly in order to produce sticks of a certain size, however experience has shown that the weights of sticks of the same size vary. Tests have shown that this varying weight in sticks of equal size is dependent on which area of the original deep-frozen piece the sticks were cut from. The middle layer of a rectangular piece has in fact a hicher specific weight than the two outer layers. In addition to this cause the thickness tolerance of the rectangular piece is also responsible for the varying weight of the sticks. If the cuttings are achieved after alignment to a stop on one side, a thickness tolerance is exclusively effected in the layer opposite the stop, so that there is a danger that the sticks produced from this layer no longer lie in the range of tolerance.

The object of the invention consists in a device for producing rectangular bars in particular by cutting singly and in multiples, with which discs can be cut taking into consideration the varying dustribution of density in the layers of the bars and the tolerances in the thickness of the bars, whereby a better yield of sticks, which lies in the admissible range of tolerance, can be produced from the said discs.

This object is solved according to the invention by a device of the type stated above, in that a further lateral stop is positioned on the opposite side to the lateral stop under formation of a transit slot for the bar and that these two stops are coupled by a gear in such a way that they can be uniformly pressed apart against the force of a spring.

Each dividing element is adjusted in the device according to the invention taking into consideration the varying distribution of density over the width of the bar which is established by measurements. With two dividing elements the alignment is achieved according to the middle layer between the two stops. As the middle layer according to the invention has the higher density, the distance between the two dividing elements in the double dividing is smaller than the distance between the dividing elements and the stops. The varying density in the individual discs is compensated by this varying thickness of the discs produced from the bar to obtain sticks of equal weight. The two stops coupled together by means of a grear ensure that each bar is fed into the centre of the dividing elements. Thickness tolerances in the individual bars are uniformly distributed between the outer discs differently to the device with the stop on one side, so that with the device according to the invention even such tolerances can be absorbed, which would drop out of the range of tolerance, if an addition is made to only one outer disc.

Parallelogram guides are preferably arranged on the stops lying opposite each other. These parallelogram guides can be coupled by intermeshing tooth segments.

So that the bar entering the device only needs to press the stops slightly apart, it is of advantage to provide an abutment which is especially adjustable for limiting the minimal width of the slot against which be parallelogram guides of the stops are pressed by the spring. The minimal width of the slot hereby depends on the smallest width expected of the bar entering the device.

In order to provide the bars, which can vary in thickness over their length, with good central guidance on the whole of their length, several pairs of stops can be arranged with parallelogram guides in sequence one after the other.

The invention is described in more details as follows by means of a drawing which schematically shows an example the invention in top view:

The device has a table 1 and as dividing elements two belt saws 2, 3 (only briefly outlined in the drawing) and several pairs of stops 4, 5, 6 which have the same form. The pair of stops 4 has two stop furnaces 8, 9 which run parallel on the middle line 7 and are arranged at equal distance therefrom; the said surfaces 8, 9 being bent outwards at the entrance for easier introduction of a bar 10. Each of these stop surfaces 8, 9 is held by two parallel arms 10, 11, 12, 13. The arms 10 to 13 are connected to the table 1 swivelling, so that the two stop surfaces 8, 9 move outwards at equal distances from the middle line 7, the arms 11, 13 are coupled in their positions by intermeshing tooth segments 14, 15. The tooth element 14 is held by a tension spring 16 touching the tooth element 14 so as to about an adjustable screw bolt 17, so that both stop surfaces 8, 9 are held apart.

When a rectangular bar 18 is fed into the device, this bar being usually wider than the slot formed by the stop surfaces 8, 9, it presses the two stop surfaces 8, 9 apart. Even if the bar 18 is not fed centrally into the device and then consequently strikes against one stop surface pushing the stop surface back, the other stop surface is also moved outwards because of the gear coupling. The tension spring 16 ensures that the bar 18 is in a central position in the table 1. During the passage of the bar 18 through the device the stop surfaces 8, 9 remain as aboutment to the outer sides of the bar 18 even if the thickness of the bar varies, guaranteeing that the bar 18 is guided to the middle. The two endless saw blades 2, 3 arranged offset in the transport direction saw the bar into discs of various thicknesses taking into consideration the varying distribution of density (specific weight) over its width.

I claim:

1. Device for dividing rectangular bars singly and in multiples produced by dividing rectangular blocks especially of deep-frozen fish, comprising a table with a laterally adjustable stop for the bars to be cut and at least one dividing element arranged at a lateral distance therefrom, in particular an endless saw blade, wherein a further lateral stop is positioned on the opposite side to the lateral stop under formation of a transit slot for the bar and that these two stops are coupled by a gear in such a way that they can be uniformly pressed apart against the force of a spring.

2. Device according to claim 1, wherein parallelogram guides are provided for the stops positioned opposite one another.

3. Device according to claim 1 wherein the gear has two intermeshing tooth elements coupling the two parallelogram guides.

4. Device according to claim 1 wherein an adjustable abutment is provided for limiting the minimal width of the slot formed by both stops and either one of the parallelogram guides, one of the tooth segments or one of the stops is pressed against the said abutment.

5. Device according to claim 1, wherein several pairs of stops are arranged in sequence one after the other.

* * * * *